US008360143B2

(12) United States Patent
Ziauddin et al.

(10) Patent No.: US 8,360,143 B2
(45) Date of Patent: Jan. 29, 2013

(54) METHOD OF DETERMINING END MEMBER CONCENTRATIONS

(75) Inventors: Murtaza Ziauddin, Abu Dhabi (AE); Ozgur Karacali, Doha (QA)

(73) Assignee: Schlumberger Technology Corporation, Sugar Land, TX (US)

( * ) Notice: Subject to any disclaimer, the term of this patent is extended or adjusted under 35 U.S.C. 154(b) by 160 days.

(21) Appl. No.: 12/635,002

(22) Filed: Dec. 10, 2009

(65) Prior Publication Data

US 2011/0139442 A1 Jun. 16, 2011

(51) Int. Cl.
*E21B 49/08* (2006.01)

(52) U.S. Cl. ..... 166/250.01; 73/152.23

(58) Field of Classification Search ..... 166/250.01; 73/152.23, 152.29
See application file for complete search history.

(56) References Cited

U.S. PATENT DOCUMENTS

| | | | | |
|---|---|---|---|---|
| 3,905,226 | A | 9/1975 | Nicolas | |
| 4,793,414 | A | 12/1988 | Nguyen et al. | |
| 4,803,873 | A | 2/1989 | Ehlig-Economides | |
| 5,602,755 | A * | 2/1997 | Ashe et al. | 702/30 |
| 6,240,787 | B1 * | 6/2001 | Alexander | 73/861.49 |
| 6,944,563 | B2 * | 9/2005 | Melb.o slashed. et al. | 702/100 |
| 2007/0213963 | A1 | 9/2007 | Jalali et al. | |
| 2009/0037113 | A1 | 2/2009 | Akram et al. | |
| 2009/0266175 | A1 * | 10/2009 | Monmont et al. | 73/861.04 |
| 2010/0307743 | A1 | 12/2010 | Ziuddin | |

FOREIGN PATENT DOCUMENTS

WO 2005075972 A1 8/2005

OTHER PUBLICATIONS

International Search Report of PCT Application Serial No. PCT/US2010/059602 dated Jul. 28, 2011.

* cited by examiner

*Primary Examiner* — William P Neuder
(74) *Attorney, Agent, or Firm* — James Kurka

(57) ABSTRACT

A method of determining a concentration of a component in a flow from a single source or layer contributing to a total flow using the steps of measuring the total flow rate at various depths and sampling the total flow at a depth between two successive sources, measuring a total concentration of one or more flow components within the total flow, repeating the measuring of the total flow rate, the sampling and total concentration in further intervals separating other pairs of successive sources, and determining the concentration of at least one component by solving a system of mass balance equations representing the total flow of the flow components at each sampling depth.

8 Claims, 5 Drawing Sheets

METHOD OF DETERMINING END MEMBER CONCENTRATIONS

FIELD OF THE INVENTION

The invention relates to methods of determining the end member concentrations of flow components from sources or zones contributing to a total production flow and/or allocating the relative contributions of two or more distinct sources in a well or several wells to the total flow based on compositional analysis or compositional fingerprinting.

BACKGROUND

In hydrocarbon exploration and production there is a need to analyze the composite production flow from a well or a group of wells in order to investigate their origin and properties. The production system of a developed hydrocarbon reservoir includes typically pipelines which combine the flow of several sources. These sources can be for example several wells or several producing zones or reservoir layers within a single well. It is a challenge in the oilfield industry to back allocate the contributions of each source from a downstream point of measurement at which the flow is already commingled.

Other than for back allocation, compositional analysis of single sources or layers can be used to study further phenomena such as reservoir compartmentalization, invasion or clean-out of drilling fluid filtrates.

It is further known that oil samples can be analyzed to determine the approximate composition thereof and, more particularly, to obtain a pattern that reflects the composition of a sample known in the art as fingerprinting. Such geochemical fingerprinting techniques have been used for allocating commingled production from a multilayered reservoir.

There are many known methods of fingerprinting. Most of these methods are based on using a physico-chemical methods such as gas chromatography (GC), mass spectroscopy or nuclear magnetic resonance or similar methods in order to identify individual components of a complex hydrocarbon mixture and their relative mass. In some known applications, combination of gas chromatograph and mass spectroscopy (GC-MS) are used to detect spectra which are characteristic of individual components of the complex hydrocarbon mixture.

Most fingerprinting techniques as known in the art are based on the identification and quantification of a limited number of selected components which act as geomarker molecules. Such methods are described for example in U.S. Pat. No. 5,602,755A to Ashe et al. and in International Publication No. WO 2005075972. Further methods using compositional analysis for the purpose of back allocating well production are described in the U.S. Pat. No. 6,944,563 to Melbø et al.

Conventional methods of production allocation by geochemical fingerprinting techniques require the collection of clean end member fluid samples (single zone fluid samples) prior to back allocation the commingled fluids. The clean sample is collected mostly through downhole sampling using a tool with a sampling probe or a sampling tool between two packers to confine the sampling interval. Tool runs for downhole sampling are complex, expensive and may not be feasible in many scenarios, and therefore limit the general application of the known geochemical fingerprinting techniques for production allocation.

In a different branch of oilfield technology there is known a family of methods commonly referred to as production logging. Production logging is described in its various aspects in a large body of published literature and patents. The basic methods and tools used in production logging are described for example in the U.S. Pat. No. 3,905,226 to Nicolas and the U.S. Pat. No. 4,803,873 to Ehlig-Economides. Among the currently most advanced tools for production logging is the FlowScanner™ of Schlumberger.

In the light of the known methods it is seen as an object of the present invention to provide a method of determining the end member concentrations of subterranean sources or zones contributing to a total flow, back allocating and/or using geochemical fingerprinting methods without the need for prior knowledge or collection of end member fluid samples.

SUMMARY OF INVENTION

This invention relates to a method of determining a concentration of a component in a flow from a single source or layer contributing to a total flow using the steps of measuring the total flow rate at various depths and sampling the total flow at a depth between two successive sources, measuring a total concentration of one or more flow components within the total flow, repeating the measuring of the total flow rate, the sampling and total concentration in further intervals separating other pairs of successive sources, and determining the concentration of at least one component by solving a system of mass balance equations representing the total flow of the flow components at each sampling depth.

Accordingly, the present invention provides a method for production allocation by geochemical fingerprinting without the collection of end member samples of the geomarkers to be used, and hence offers a significant advantage over conventional methods.

The method is best performed using a tool combining flow measuring and sampling capabilities thus reducing the number of tool runs through the well to one thus significantly decreasing costs and risks associated with downhole logging operations, particularly when compared to the conventional sampling of end member samples.

The depth locations or stations at which samples are taken from the flow in the well are best selected with prior knowledge of the location of the sources. In a cased hole completion, these stations are preferably selected to be above each set of perforations which open a zone to the well. In case of an uncased or open completion of a well, the depth can be established for example using a gamma ray log.

In their most basic application, methods of the present invention can be used to determine the concentrations of a single component such as $H_2S$ in several sources. For geomarking applications it is often preferred to measure a large number of components.

The sources are typically geochemically distinguishable layers or zones within a hydrocarbon reservoir. Geochemically distinguishable layers differ in the concentration of the geomarkers. In case that a reservoir is compartmentalized such that the same geochemically distinguishable layers or zones are produced through more than one well, it is possible to spread the measurements required for the new method between those wells.

In a preferred embodiment of the invention, the relative contributions of two or more producing subterranean sources are determined using the mass balance of the flows from the sources and the total flow. The flow properties and end member concentration of geomarkers or components of a source established as part of the inventive method can be used for production control purposes such as maintaining for example the concentration of unwanted components in the flow below a desired maximum In a further preferred embodiment of the invention, the concentrations of geomarkers as determined through the use of the novel method are applied to methods of back allocating production or determining flow rates of individual layers.

These and other aspects of the invention are described in greater detail below making reference to the following drawings.

DETAILED DESCRIPTION

Figure 1:
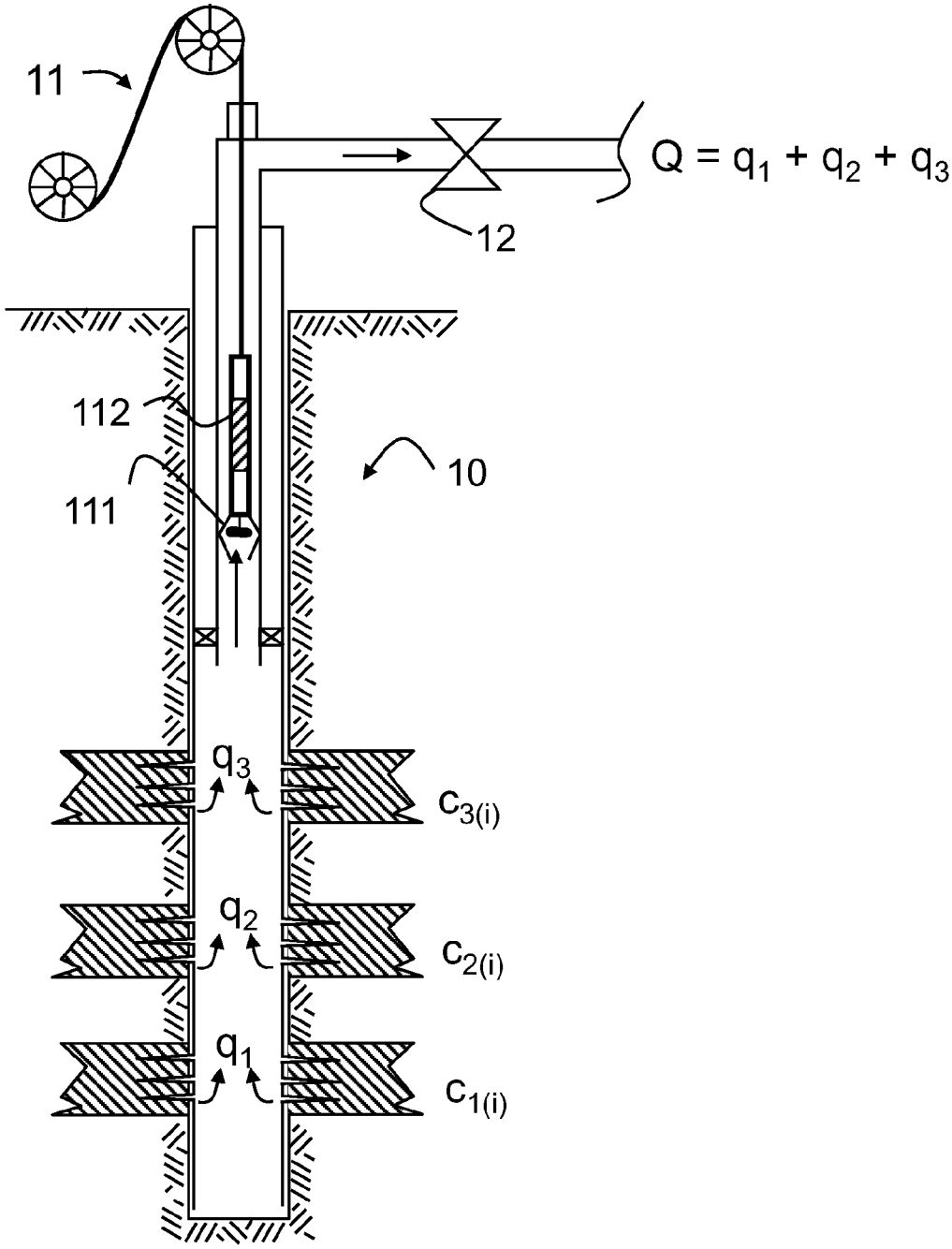
FIG. 1 illustrates steps of a method in accordance with an example of the invention applied to a reservoir with three producing layers.

The method is illustrated by the following example, in which FIG. 1 shows an oil well 10 drilled in a formation containing several oil-bearing layers. In this example, the number of separate layers is chosen to be three to allow for a clearer description of elements of the present invention. However, the number of layers can vary and the below described example is independent of any specific number of layers.

In the example, there is assigned to each layer a flow rate $q_1$, $q_2$, and $q_3$, respectively. The fluids produced from the three layers contain chemical components at the so-called end member concentrations $c_{1i}$, $c_{2i}$ and $c_{3i}$, respectively, wherein the index number i denotes a specific component i in the fluid.

In the present example, the component i stands for any component or species being part of the flow stemming from the respective zone. Any such component can be selected as geomarker for later application of a back allocation through fingerprinting. It will be apparent from the following description that the method can be applied to any number of such components or geomarkers as long as they are identifiable in the samples.

In accordance with known geochemical fingerprinting methods, the end member concentrations $c_{1i}$, $c_{2i}$ and $c_{3i}$ of a component i in the fluid would be determined using commercially available formation testing or end member sampling tools and methods, such as Schlumberger's MDT™. When using these methods, the tool samples each layer separately with specialized probes designed to minimize cross-flow from the well or from neighboring zones. With the direct measurement of the end member concentrations from such samples, the process of analyzing the flows for the concentrations of geomarkers becomes relatively straightforward.

However, the use of these specialized formation sampling tools to determine end member concentrations is cost intensive and time consuming. The sampling step is a technically challenging operation inside the wellbore, requiring for example a long stationary period to place the probe onto the formation face and extracting the volume through the relatively limited probe opening.

The example of the invention as described in following does not depend on the separate and individual sampling of the downhole layers. Instead, the samples can be taken from the normal production flow through the well, as the method accounts for the mixing of flow from different zones.

In the example of the invention a combination of production logging tool (PLT) and a sampling tool is used to perform the required measurements and sampling in a single downhole run of the combined tools. However, the method could work even if the tools are run in and out of the well separately.

The present example of the invention makes use of the basic equations which govern the transport of mass from the contributing sources or layers in the well to the point of measurement of the total flow. Using the notation as presented in FIG. 1, these can be expressed for example as:

$$\text{Mole/Mass balance:} q_1c_{1i}+q_2c_{2i}+q_3c_{3i}=QC_i \quad [1]$$

The conservation of mass requires $$\text{Mass conservation:} q_i+q_2+q_3=Q. \quad [2]$$

Again it should be noted that the above equation [1] applies to any component i of the produced fluid and that equations [1] and [2] can be readily extended to accommodate any number of sources by adding the respective flow rates.

In the present example the total flow rate Q of all phases of a multiphase flow and the total concentration $C_i$ of each component i are measured.

To solve equation [1] for the concentration of the component i in the respective layers $c_{1i}$, $c_{2i}$ and $c_{3i}$, the present example uses a known combined logging tool 11. The tool 11 is a combination of a production logging tool 111, the PS Platform™ of Schlumberger and a sampling tool 112, the Compact Production Sampler or CPS of Schlumberger. When combined, the PS Platform and the Compact Production Sampler or CPS of Schlumberger form a logging tool 11 which can be used to collect flow samples and measure flow rates at several locations or depth stations in a well 10. Whilst the combination as such is known in the industry, the present invention suggests a novel and very efficient way of determining end member concentrations and flow allocation.

As details of both tools are available from the vendor, the following is only meant as a brief overview of their respective elements before describing the method for which both are used in further detail.

The PS Platform is a set of instruments which are assembled into a logging tool for evaluating the flow at subterranean locations. The tool string length can vary depending on the sensors required, with the minimum configuration being 14 ft [4.3 m] including the following components with its respective length:

Basic Measurement sonde: 8.3 ft [2.52 m]
UNIGAGE™ carrier: 4.2 ft [1.27 m]
Gradiomanometer tool: 4.8 ft [1.45 m]
Flow-Caliper Imaging tool: 5.2 ft [1.59 m]

The basic measurement sonde houses a common sensor package consisting of pressure, temperature, gamma ray and collar locator. The UNIGAGE carrier allows the inclusion of a second high-accuracy quartz pressure measurement. The gradiomanometer tool gives fluid density. It can be adapted to include an accelerometer for real-time deviation measurements and the Flow-Caliper Imaging tool provides velocity, hole size and geometry, water holdup and bubble count measurement, and relative bearing. The tool can be equipped with either a memory or telemetry module. At its minimum length of 13.5 ft [4.11 m] the tool can provide two-phase diagnosis in vertical and deviated wells. The tool's outer diameter is 1 11/13 or 2⅛ in. depending on whether its centralizers include skids or rollers.

The Compact Production Sampler is a mercury-free, positive-displacement bottomhole reservoir fluid sampling tool that captures conventional bottomhole samples. It is electrically actuated and modular, and Its through-wired design allows the tool to be run in any section of the PS Platform production logging string (slickline or electric line conveyed) or in any section of a memory production logging string. It further allows a fullbore flowmeter to be run simultaneously at the bottom of the PS Platform production logging string. The system's ability to run a production log before taking the fluid sample allows selective fluid sampling at specific depths. The operator can rely on time delay or use from the surface an electronic firing system like eFire™ to initiate the sample collection. The sampler collects a 100 cc conventional bottomhole sample and the sampling chamber or bottle can be shipped directly to a laboratory for analysis.

The concentration measurement itself can be based on optical, IR or mass spectroscopic, gas or other chromatographic methods or any other known method which is capable of discriminating between species and their respective amounts in the sampled fluids. Though the exact method used to determine the concentrations is not a concern of the present invention, it appears that at the present state of art GC-MS or GC×GC provide the best results. Alternatively, it is feasible to adapt the more advanced analytical capabilities of the known MDT tool or modules thereof to perform at least a first approximate concentration measurement of some components of the flow while taking the sample.

Figure 2A:
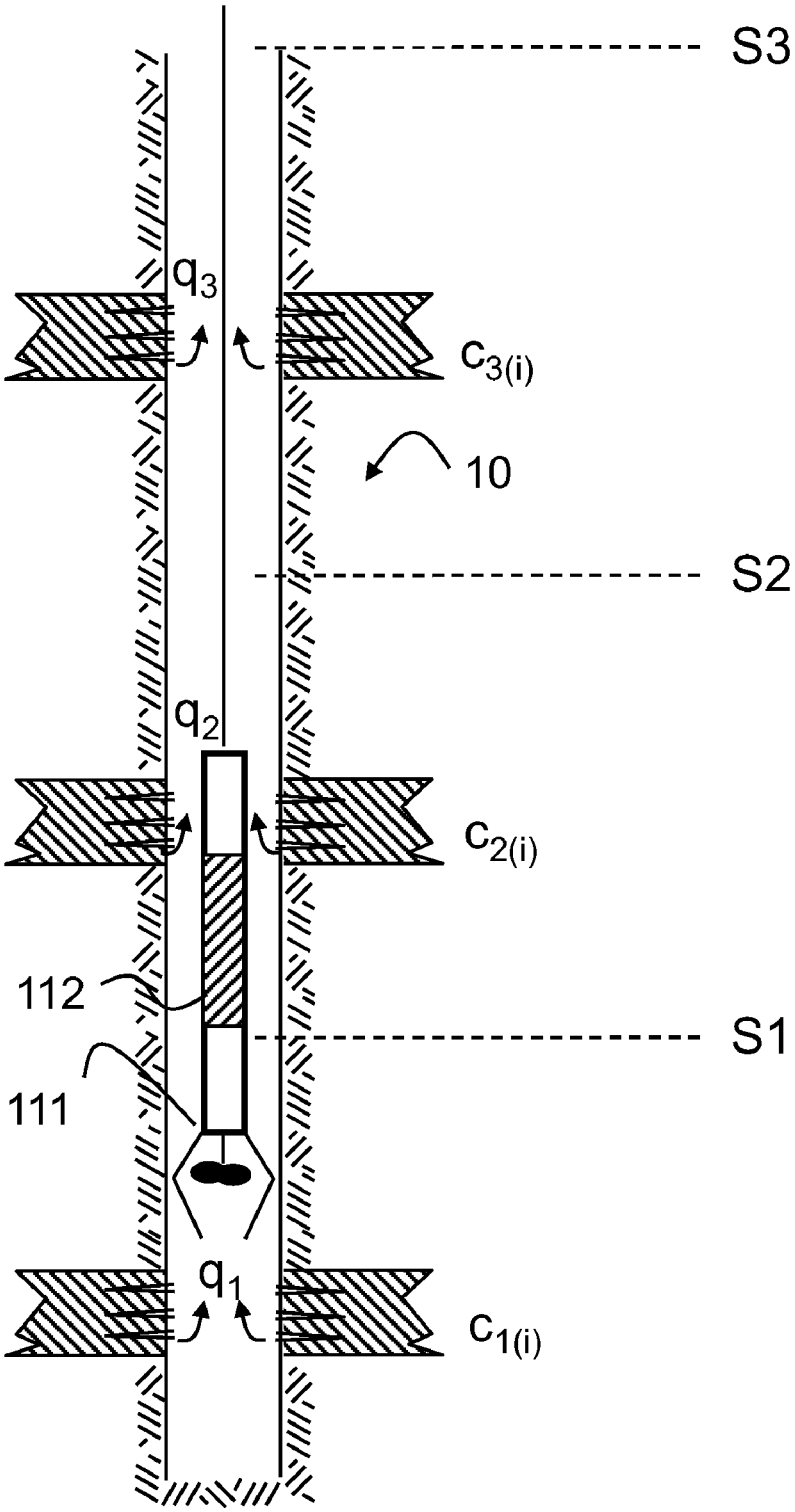
FIGS. 2A-2C illustrate further steps of a method in accordance with an example of the invention.
Figure 2B:
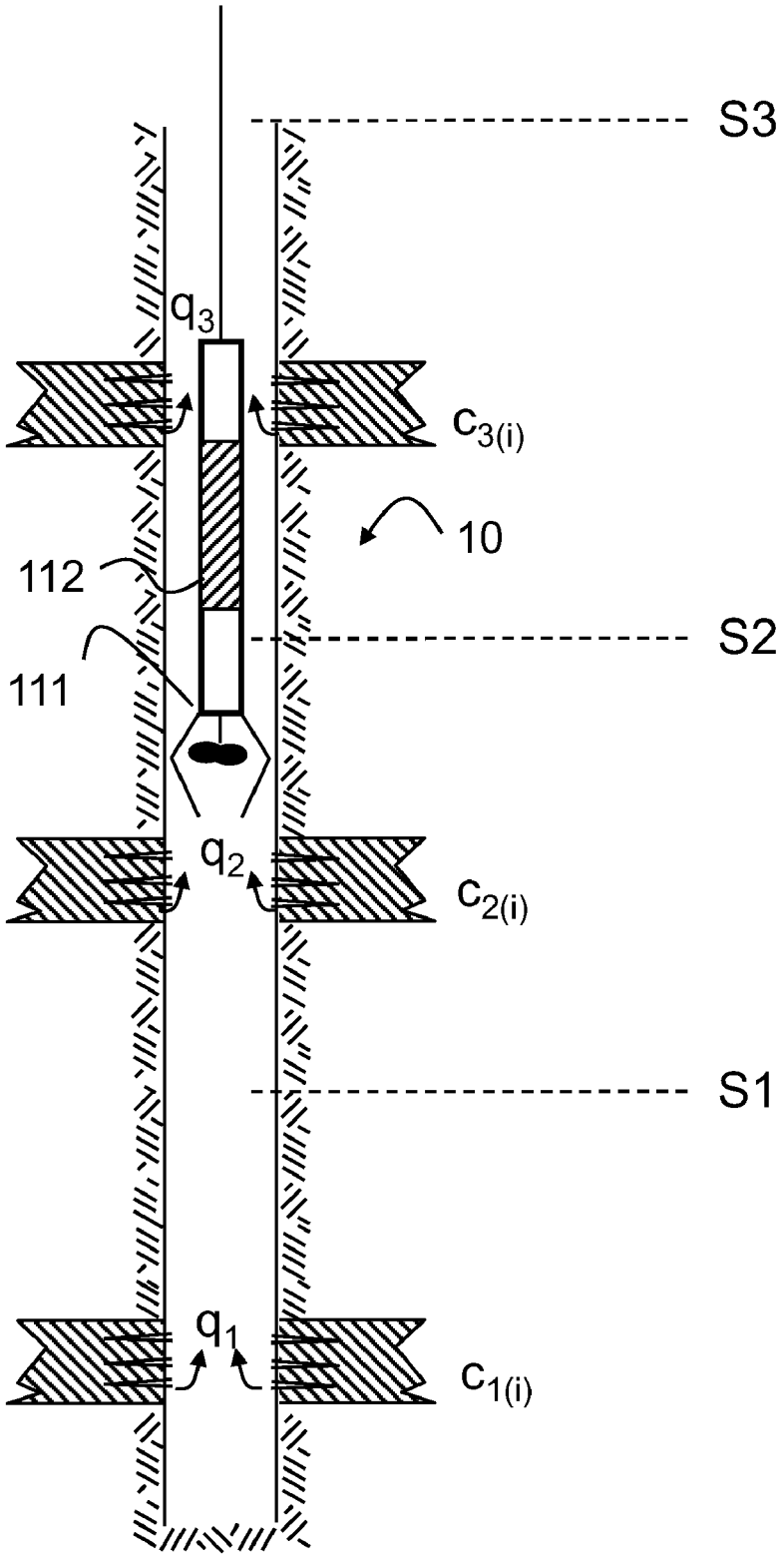
Figure 2C:
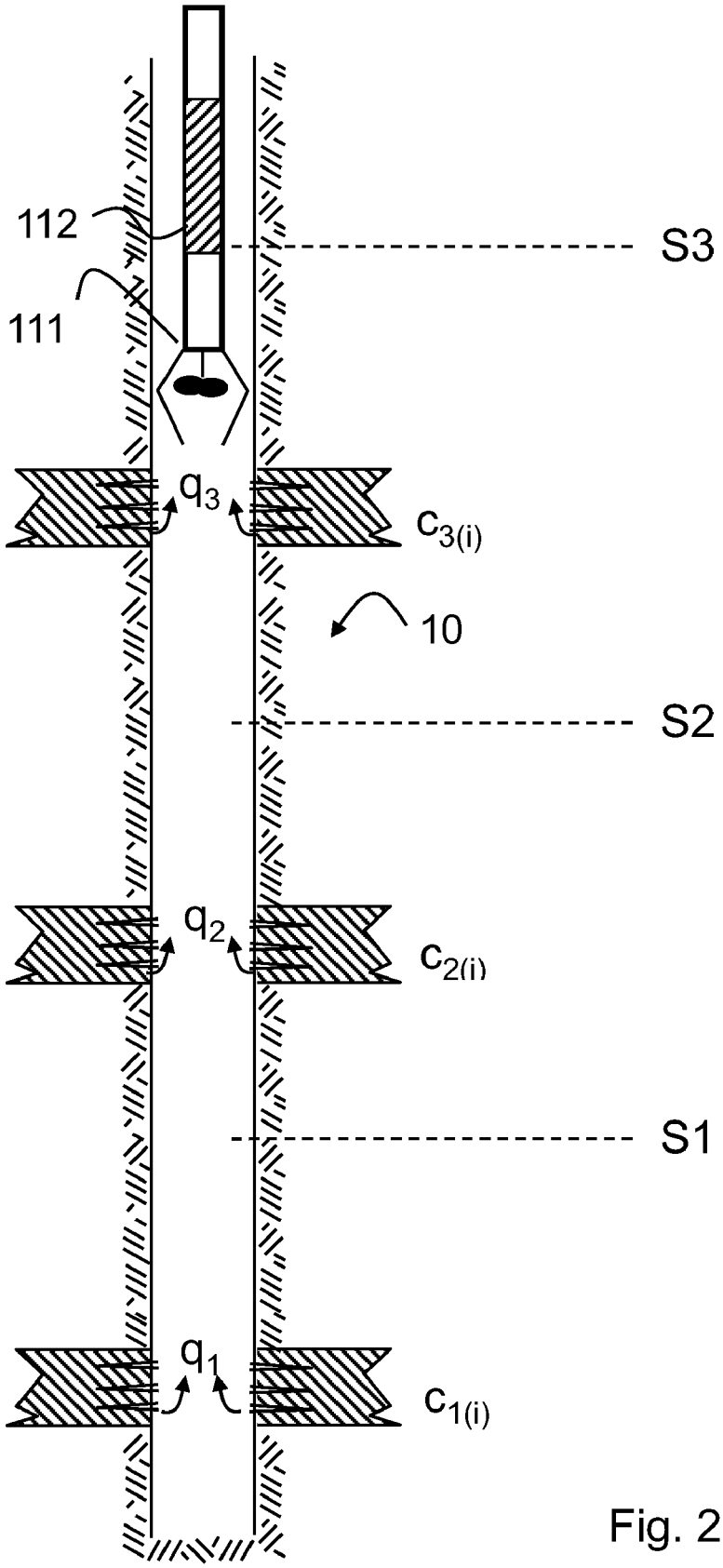

Having described a tool configuration, the following part of the specification describes an application in accordance with the invention. As an example, the sequence of FIGS. 2A-2C illustrates three depth stations of the combined tool 11 together with the governing flow balance equation [1] at each of the stations. These equations are at $$q_1c_{1i}=Q(1)C_i(1) \qquad \text{Station S1 (FIG. 2A)}$$

$$q_1c_{1i}+q_2c_{2i}=Q(2)C_i(2) \qquad \text{Station S2 (FIG. 2B)}$$

$$q_1c_{1i}+q_2c_{2i}+q_3c_{3i}=Q(3)C_i(3) \qquad \text{Station S3 (FIG. 2C)}$$

where the subscript numbers and letters denote the layer and component, while baseline numbers denote the station number which in turn translates into depth (as measured along the well). Making use of the mass conservation equation [2] at each station, i.e.:

$$q_1=Q(1) \qquad \text{Station S1 (FIG. 2A)}$$

$$q_1+q_2=Q(2) \qquad \text{Station S2 (FIG. 2B)}$$

$$q_1+q_2q_3=Q(3) \qquad \text{Station S3 (FIG. 2C)}$$

this system of equations can be readily solved for the unknown end member concentrations $c_{1i}$, $c_{2i}$ and $c_{3i}$ and flow rates $q_1$, $q_2$ and $q_3$ for each of the three sources.

Figure 3:
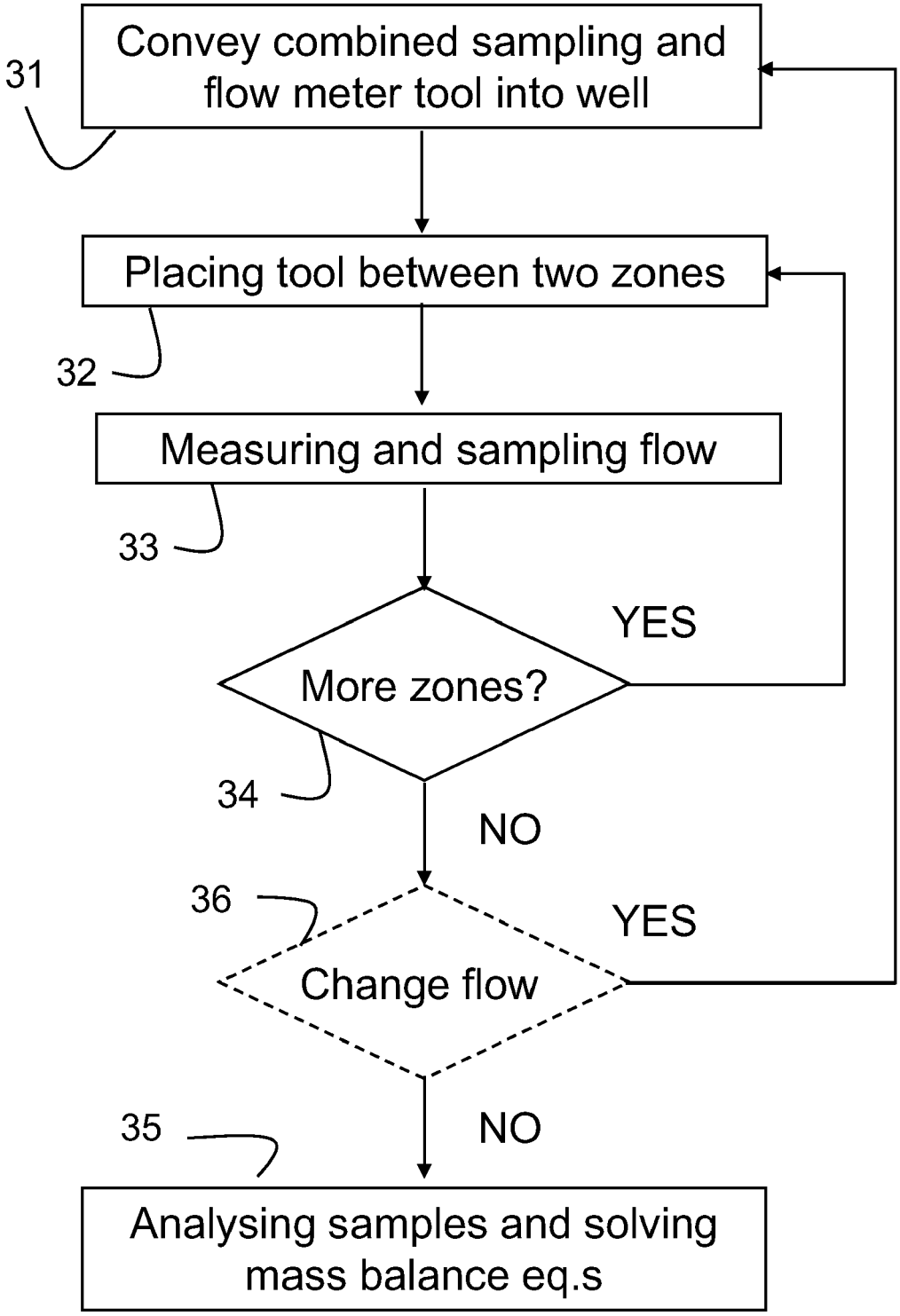
FIG. 3 is a flow chart summarizing steps of a method in accordance with an example of the invention.

With reference to the example of FIGS. 1 and 2A-2C, a method as proposed by the present invention can be described as a flow chart as shown in FIG. 3. The steps of FIG. 3 include assembling a combination of a downhole flow metering and sampling device and lowering the combined tool into the subterranean formation (Step 31). The combined tool can be attached to any of the known conveyance systems such as wireline, slickline, pipe or tractor system, all of which are well established in the industry. In the next step 32, the combined tool is placed between two successive sources or layers, for example position S1 of FIG. 2. In Step 33 the flow rate of the total flow in the well is measured and a sample is taken from the total flow at this location. The steps 32 and 33 are repeated for every known source or layer (Step 34). Once the desired number of measurements is taken, the samples are returned to the surface and analyzed as described above to determine the composition and, by solving the system of equation [1], [2], the end member concentrations of specific components of the flow (Step 35).

The above described example can be improved by repeating the measurements at different flow rates as indicated by the optional step 36. The flow rates can be changed for example by opening or choking a choke valve 12 as shown in FIG. 1. Such choke valves are part of the standard surface installations of the flow lines from the wells to the production facilities.

When set to a second state by either closing or opening the valve, the different pressure drop between the downhole layers and the surface causes a change in flow conditions. This change is reflected by extending the above set of equations for each station to a more general case using the index k to indicate different flow conditions, e.g.:

$$q_1(k)c_{1i}=Q^k(1)C_i^k(1) \qquad \text{Station S1 (FIG. 2A)}$$

$$q_i(k)c_{1i}+q_2(k)c_{2i}=Q^k(2)C_i^k(2) \qquad \text{Station S2 (FIG. 2B)}$$

$$q_1(k)c_{1i}+q_2(k)c_{2i}+q_3(k)c_{3i}=Q^k(3)C_i^k(3). \qquad \text{Station S3 (FIG. 2C)}$$

While changing the surface choke valve provides a ready way of changing flow conditions, other methods can be used to similar effect. Such methods include the use of downhole valves systems or methods which temporarily block the flow of single layers, effectively setting its flow rate to zero. It is also possible to exploit the effects of standard formation stimulation treatments which typically change the flow from each layer differently, thus changing the relative flow rate of each layer compared to those before the stimulation treatment. Suitable stimulations treatments include fracturing and/or matrix acidization.

Instead of changing the flow condition in one well, measurements may be taken from different wells within the same compartment of the reservoirs. This variant of the invention assumes firstly the flow condition and hence the relative flow rates of the layers differ from well to well and secondly that within a compartment the end member composition of the layers are identical.

In an extension of the methods of this invention, the end member concentrations can be used for back allocation purposes. The above equations can also be used to determine the zonal flow rates, once the end member compositions are established and can be assumed to remain stable over the period of observation.

Using the methods described in the co-owned U.S. patent application Ser. No. 12/480,894 filed 9 Jun. 2009, the reservoir pressures can be derived from the results of methods in accordance with the present invention.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative processes, one skilled in the art will recognize that the system may be embodied using a variety of specific procedures and equipment and could be performed to evaluate widely different types of applications and associated geological intervals. Accordingly, the invention should not be viewed as limited except by the scope of the appended claims.

What is claimed is:

1. A method of determining end member concentrations of flow components from two or more subterranean sources contributing to a total flow, the method comprising the steps of measuring a total flow rate and sampling the total flow at a downhole position within an interval between two successive sources;

measuring a total concentration of one or more flow components within said total flow as sampled at the downhole position;

repeating the measuring of the total flow rate, the sampling and the total concentration at positions within intervals between further pairs of successive sources and determining the end member concentration for at least one component by solving a system of mass balance equations representing the total flow of the one or more flow components at each of the downhole sampling positions.

2. A method in accordance with claim 1, performed as part of a production logging operation.

3. A method in accordance with claim 1, wherein the step of measuring the flow rates and the step of sampling the total flow is performed during a downhole run of a subterranean flow metering device and a sampling device mounted onto a single conveyance tool.

4. A method in accordance with claim 1, including the step of determining the end member concentration of the one or more components for use as geomarkers.

5. A method in accordance with claim 4, using the geomarkers to back allocate the fluid flow.

6. A method in accordance with claim 1, repeating the steps after changing the relative flow rates from the sources.

7. A method in accordance with claim 6, wherein the relative flow rates are changed using one or more choke valves at surface locations.

8. A method in accordance with claim 1, wherein said sources are hydrocarbon producing zones or layers.

* * * * *